US005398537A

United States Patent [19]

Michalewski et al.

[11] Patent Number: 5,398,537

[45] Date of Patent: Mar. 21, 1995

[54] LOW AMPERAGE ELECTROMAGNETIC APPARATUS AND METHOD FOR UNIFORM RIVET UPSET

[75] Inventors: David Michalewski, Cheektowaga; Joseph A. Dionne, West Seneca, both of N.Y.

[73] Assignee: Gemcor Engineering Corporation, Buffalo, N.Y.

[21] Appl. No.: 802,889

[22] Filed: Dec. 6, 1991

[51] Int. Cl.[6] ..... B21J 15/24

[52] U.S. Cl. ..... 72/430; 72/19; 29/243.54

[58] Field of Search ..... 72/430, 391.2, 19; 29/243.53, 243.54

[56] References Cited

U.S. PATENT DOCUMENTS 2,976,907 3/1961 Harvey et al. .
3,058,117 10/1962 Moore .
3,171,302 3/1965 Baker .
3,267,337 8/1966 Doyle et al. .
3,412,451 11/1968 Vieser et al. .
3,434,026 3/1969 Doyle .
3,559,269 2/1971 Schmitt et al. .
3,564,883 2/1971 Koors et al. ..... 72/19
3,646,791 3/1972 Leftheris .
3,697,837 10/1972 Umbaugh .
3,704,506 12/1972 Orr et al. .
3,731,370 5/1973 Leftheris .
3,737,990 6/1973 Schut .
3,811,313 5/1974 Schut .
3,824,824 7/1974 Leftheris .
3,870,931 3/1975 Myers .
3,945,109 3/1976 Leftheris .
3,961,739 6/1976 Leftheris .
4,000,680 1/1977 Briles .
4,039,034 8/1977 Wagner .
4,051,592 10/1977 Briles .
4,086,839 5/1978 Briles .
4,091,260 5/1978 Leftheris et al. .
4,120,367 10/1978 Wagner .
4,128,000 12/1978 Hogenhout et al. .
4,129,028 12/1978 Leftheris et al. .
4,132,108 1/1979 Hogenhout .
4,151,735 5/1979 McDermott .
4,159,666 7/1979 Briles .
4,274,046 6/1981 Harrison .
4,417,463 11/1983 Nelson .
4,423,620 1/1984 Hogenhout et al. .
4,531,393 7/1985 Weir .
4,553,074 11/1985 Jacquemet .
4,653,300 3/1987 Crout et al. .
4,659,969 4/1987 Stupak, Jr. .
4,684,820 8/1987 Valencia .
4,698,991 10/1987 Kirii et al. .
4,707,619 11/1987 Chu et al. .
4,723,429 2/1988 Weber et al. .
4,743,821 5/1988 Hall .
4,754,643 7/1988 Weeks, Jr. et al. .
4,760,723 8/1988 Nakagawa .
4,836,008 6/1989 Weber .
4,862,043 8/1989 Zieve ..... 72/430
4,895,322 1/1990 Zieve .
4,912,343 3/1990 Stuart .
4,990,805 2/1991 Zieve .
5,009,091 4/1991 Hinterman et al. .

FOREIGN PATENT DOCUMENTS 0293257 11/1988 European Pat. Off. .
0090216 4/1991 Japan ..... 72/19

OTHER PUBLICATIONS

Zieve, Peter B., "Low Voltage Electromagnetic Riveter", Fastec West '86, Oct. 21-23, 1986, AD86-680.
Hartmann, John, "Rivet Quality in Robotic Installation", Fastec '89, Oct. 4-6, 1989, 1989, AD89-640.
Black & Webster Air-Hydraulics, "Assembly & Forming Product Catalog", pp. 10-11, Catalog No. 1090.

*Primary Examiner*—David Jones
*Attorney, Agent, or Firm*—Hodgson, Russ, Andrews, Woods & Goodyear

[57] ABSTRACT

A riveting apparatus and method wherein riveting upset force is provided by a solenoid operated plunger wherein the current provided to the coil of the solenoid is controlled such as by a servo-controller to achieve rivet upset time versatility whereby cracking may be minimized while maintaining high quality rivet upset uniformity. A condition such as plunger velocity or applied force during upset is sensed, and signals indicative of the condition are fed back to the servo-controller so that the condition may be instantaneously adjusted as the plunger is moved for rivet upset.

20 Claims, 3 Drawing Sheets

LOW AMPERAGE ELECTROMAGNETIC APPARATUS AND METHOD FOR UNIFORM RIVET UPSET

This invention relates generally to the riveting art and more particularly to a new and improved electromagnetic riveting apparatus and method.

As an alternative to traditional pneumatic and hydraulic approaches, electromagnetic actuators have been prepared for riveting apparatus. An early attempt is illustrated in U.S. Pat. No. 3,171,302 which discloses a rivet setting machine including a solenoid which operates through a bell crank for reciprocating a plunger which drives a rivet.

An electropunch which utilizes a solenoid is commercially available from Black & Webster Assembly Equipment Division of Air Hydraulics of Jackson, Mich. Control of the electropunch is described as achievable with either a variable transformer impact control or a Power Pak control which insures consistent strokes. The electropunch is further described as an impact tool for assembly operations of staking, riveting, swaging, and marking parts. The impacting of a rivet directly by the plunger of this machine disadvantageously limits the ability to provide automated manipulation and insertion of rivets and thus requires manual insertion of thereof. Such a machine does not provide suitable upset forces due to its extremely low current levels of perhaps 3 amps. Further, such a machine is not suitable for providing rivet upset from both sides of a workpiece such as in upsetting a headless rivet, a slug that can provide fluid-tight riveted joints in metal workpieces.

During the formation of, for example, aerospace structures such as the wings of aircraft, it is important that the rivet uniformly provide a good interference fit with the rivet hole. Thus, the upsetting force should provide a rivet flow which uniformly fills and stretches the hole so as to uniformly enhance the mechanical characteristics of the structure as well as to provide adequate sealing of the joint where required. The trend of aircraft to have thinner wings requires that the panels be thicker so that strength is not compromised. The thicker panels, as well as more stringent government and industry requirements, require a greater riveting uniformity, i.e., consistently proper expansion of a rivet in a drilled hole, to ensure the higher quality product desired. Because of variables such as friction, weight, current, and temperature of the coil wire, which vary during repeated use, voltage control as provided by the Air Hydraulics machine may not achieve the desired uniformity. Presently available pneumatic or hydraulic riveting apparatus may also not provide the desired degree of uniformity as panel structures become thicker.

During the simultaneous application of upsetting force to both sides of a rivet, the equal and opposite forces cancel each other thus resulting in a low reactive force. In order to minimize panel movement during such riveting, it is desirable that the supporting structure (C-frame) be of low weight. However, the presently available pneumatic and hydraulic riveting apparatus does not allow supporting structure of suitably low weight.

A more recent approach employs development of eddy currents in an actuator in response to discharge of a capacitor bank into a coil. This is described, for example, in the technical papers "Low Voltage Electromagnetic Riveter", by P. Zieve, Society of Mechanical Engineers Fastec West '86 Conference of Oct. 21–23, 1986, at Anaheim, Calif. (AD86-680), 1986 and "Rivet Quality in Robotic Installation" by J. Hartman et al, Society of Manufacturing Engineers Fastec '89 Conference of Oct. 4–6, 1989, at Arlington Tex. (AD89-640), 1989, as well as in U.S. Pat. Nos. 4,862,043 and 4,990,805 together with published European patent application 293,257.

Electromagnetic riveting apparatus which employs capacitor discharge into a coil also is shown in U.S. Pat. Nos. 3,559,269; 3,704,506; 4,423,620; 3,646,791; 3,731,370; 3,824,824; 3,945,109; 3,961,739; and 4,129,028.

The low voltage electromagnetic riveter (LVER) may undesirably require a high operating current in the range of perhaps 20,000 amps. It would be desirable to provide a light weight electromagnetic riveter which operates at a safer and more economical current level of perhaps about 200 amps with a correspondingly low voltage.

The LVER is designed so that the plunger already touches the rivet at the time of capacitor discharge to develop the upset force. This squeeze-type of apparatus thus has a plunger velocity of zero at the beginning of rivet upset yet adequate force must still be developed for rivet upset. The rapid development of the required force, starting at zero velocity, results in a rapid upset time of perhaps 0.002 second, and such a fast upset time may contribute to cracking problems. A weight and cost adding cushion member is provided for the resulting high reactive force. Such an LVER accordingly may not allow versatility for optimizing the rivet upset time for minimizing rivet cracking.

Interference-fit fasteners such as lock bolts to which nuts are applied require vibratory insertion, i.e., the slightly oversize fastener is pounded into the hole by a series of applications of force analogous to driving a nail into a wall by striking it a number of times with a hammer. The dumping of charge for developing plunger force by a capacitor bank is, however, a "one-shot" process, and further application of force undesirably requires a period of time for the capacitor bank to be re-charged. Thus, the LVER, with its "one-shot" capacitor bank, may not suitably allow vibratory insertion.

It is accordingly an object of the present invention to achieve high quality riveting wherein the rivet upset time may be modulated so that cracking is minimized.

It is another object of the present invention to provide such riveting quality and versatility while automatically locating and positioning the rivets.

It is still another object to achieve uniformity of such high quality riveting.

It is another object of the present invention to provide apparatus which is of light weight, inexpensive, rugged, safe, and easy to operate for providing such riveting quality and versatility.

It is yet another object of the present invention to provide such apparatus which can handle rivets of different sizes while still providing such riveting quality and versatility.

It is a further object of the present invention to provide such apparatus which can provide vibratory insertion of fasteners.

In order to provide rivet upset time versatility for minimizing cracking, in accordance with the present invention a solenoid actuated riveting apparatus is provided wherein current control means is operatively connected to the solenoid for providing current in such magnitude and time duration to develop force from the solenoid to effect uniform force for riveting, the solenoid plunger force being preferably provided through an anvil to the rivet or slug so that it may be located and positioned automatically. Such current control may be provided by a servo controller such as, for example, a servo amplifier. Means are provided for sensing a condition of the solenoid plunger as it is driven for impacting the anvil to form a rivet and for feeding back to the servo controller signals indicative of the condition, the servo controller being responsive to the signals from the sensing means for varying the current to the solenoid for controlling the condition during movement of the plunger. The condition sensing means may include, for example, a velocity transducer for sensing the velocity of the plunger for control thereof as the plunger means is being driven into impact with the anvil to form the rivet or may include a force transducer for sensing the force applied to the rivet as it is impacted by the anvil so that the force applied to the rivet by the plunger as the rivet is being impacted by the anvil may be controlled whereby the rivet upset time may be tailored, and vibratory insertion of fasteners may be achieved by such velocity and/or force control. By using the plunger momentum to achieve the upset force, work is performed over a relatively long period of time so that the apparatus may safely operate at a low current of perhaps about 200 amps.

The above and other objects, features, and advantages of the present invention will be apparent in the following detailed description of the preferred embodiments when read in conjunction with the accompanying drawings wherein the same reference numeral denotes the same or similar parts throughout the several views.

DETAILED DESCRIPTION OF THE PREFERRED EMBODIMENTS

Figure 2:
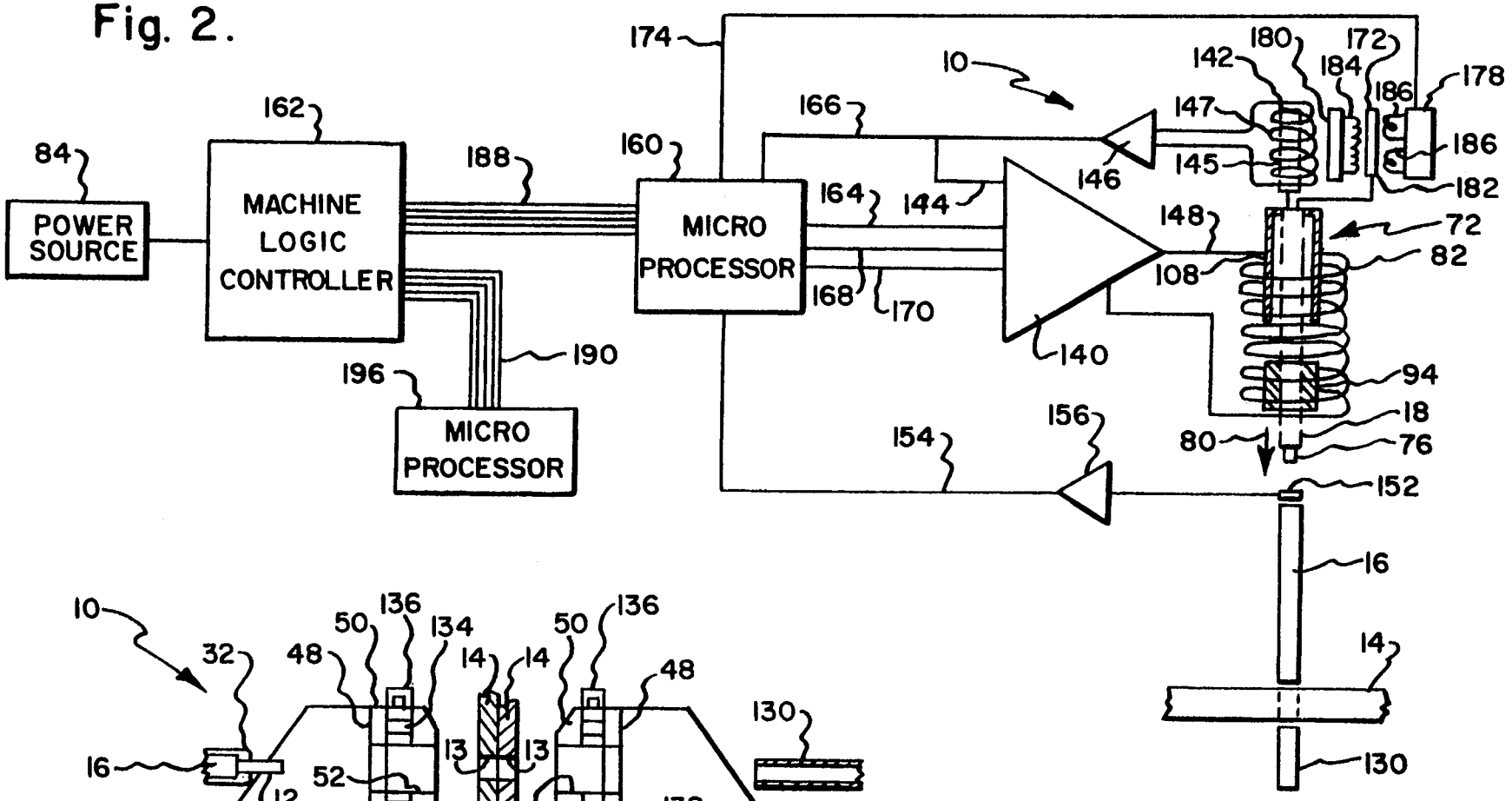
FIG. 2 is a diagrammatic view of one of the riveting apparatus of FIG. 1 and illustrating its interconnection with the other riveting apparatus.

Referring to the drawings, there is illustrated riveting apparatus 10 for inserting a rivet, or other fastener, illustrated shown at 12, into holes 13 of a pair of members 14 to be connected for riveting them together. Members 14 may, for example, be airplane wing panels requiring high impact force for uniform rivet upset. As used herein, a "slug" is generally meant to refer to a headless rivet in its form before upset force is applied to rivet members together, and a "fastener" is meant to include rivets and slugs. References herein and in the claims to "rivets" and "slugs" are meant to include other types of fasteners, as suitable, such as, for example, lock bolts which are interference fit.

Figure 3:
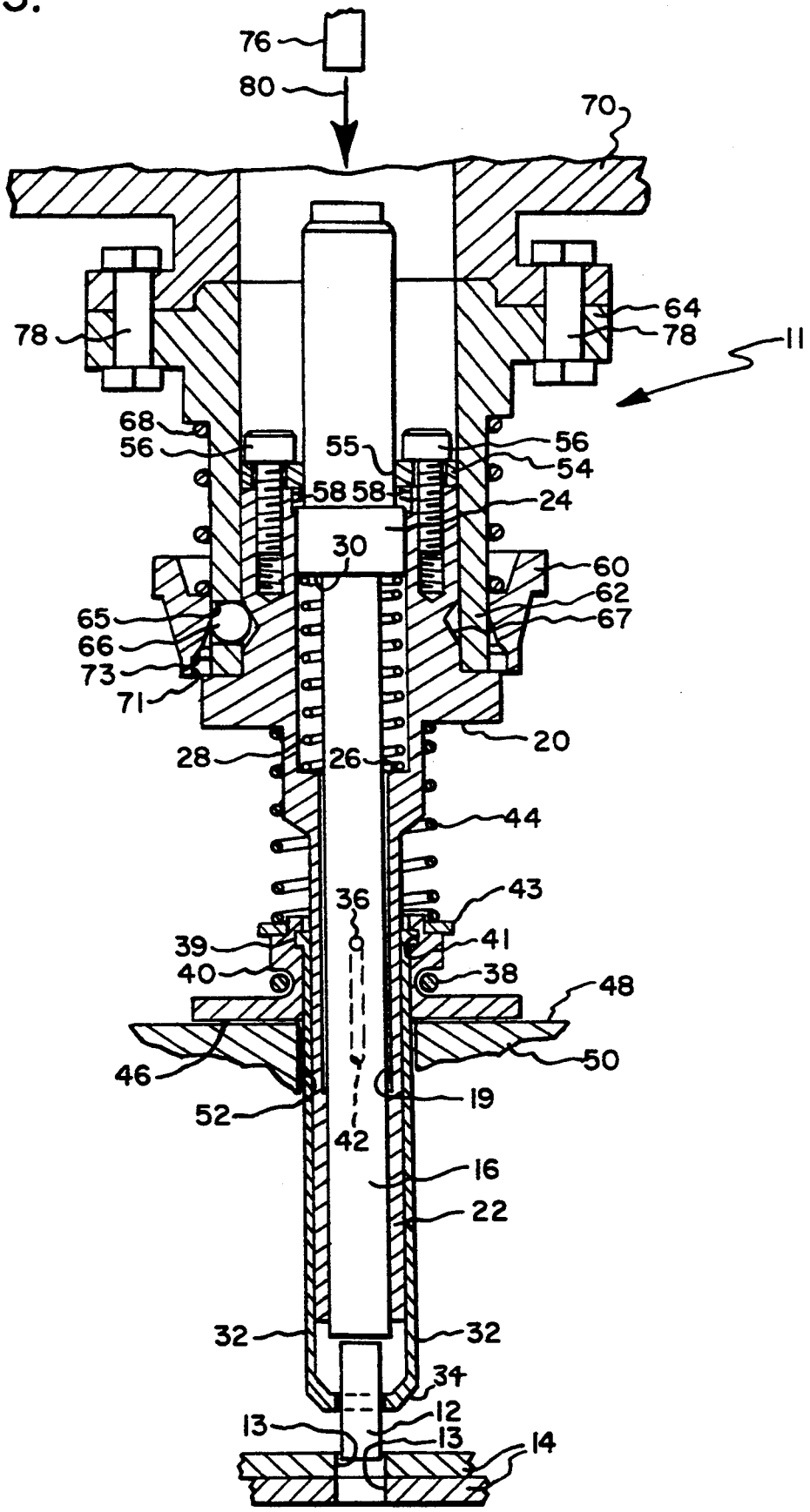
FIG. 3 is an elevational view, partly in section, of the anvil portion of the riveting apparatus of FIG. 2.

The apparatus 10 comprises impacting means, illustrated generally at 11 in FIG. 3, which includes tooling in the form of a generally cylindrical elongate ram or anvil 16. Apparatus 10 further comprises a plunger assembly, illustrated generally at 72 in FIG. 4, which includes a plunger 18 for impacting the anvil 16 to provide the force for upsetting the rivet slug 12 against a lower ram or anvil, shown at 130 in FIGS. 1 and 2, for forming the rivet. Plunger 18 includes an upset tool 76 inserted co-axially in an aperture in the lower end thereof for striking the anvil 16.

Figure 1:
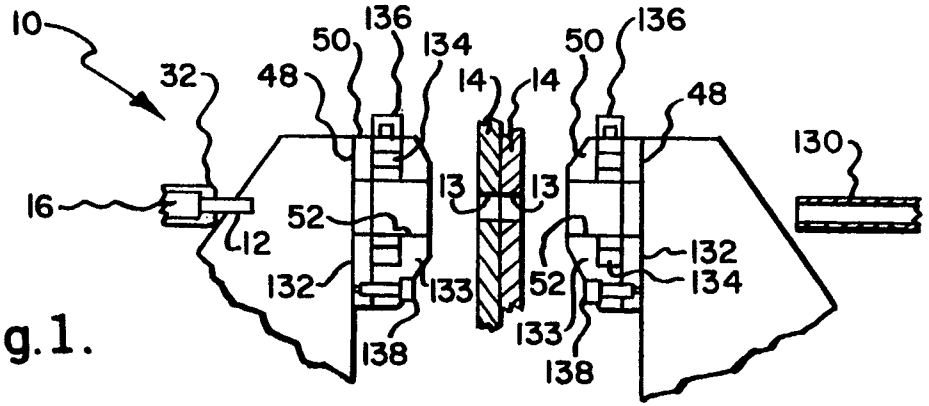
FIG. 1 is a partial side view illustrating a pair of riveting apparatus set up for forming a rivet in accordance with the present invention.
Figure 4:
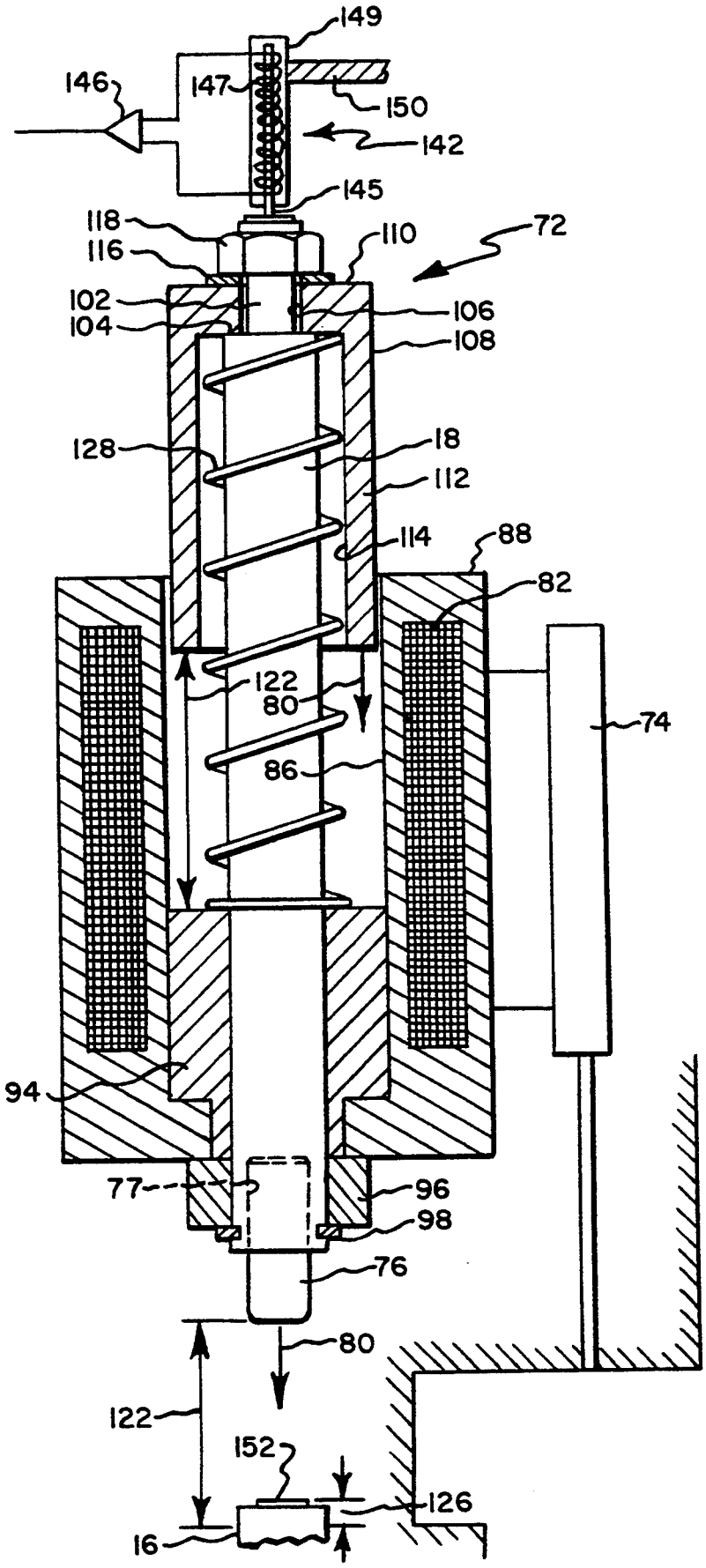
FIG. 4 is a view similar to that of FIG. 3 of the solenoid portion of the riveting apparatus of FIG. 2.

Referring to FIG. 3, the generally cylindrical elongate anvil 16 is movable vertically within an aperture 19 in a housing 20 which includes an elongate extension 22 which serves as a guide therefor and is of reduced diameter for being received through the opening 52 for reasons to be described hereinafter. While the apparatus 10 is described with reference to vertical orientation, as shown in FIGS. 2 to 4, it should be understood that it can be oriented otherwise such as horizontally, as illustrated in FIG. 1, in which case the anvil 16 would be said to be movable horizontally. As seen in FIG. 3, the clearance between the anvil 16 and the aperture 19 is reduced along the lower portion of the extension 22 so that more precise movement of the anvil may be effected.

The anvil has an enlarged or increased diameter portion 24 which rides within an increased aperture diameter portion of the housing which provides a shoulder 26 for limiting the downward movement thereof. A compression spring, illustrated at 28, surroundingly engages the anvil 16 below the enlarged portion 24 between the shoulder 26 and the anvil shoulder 30 provided by the enlarged portion 24 so as to bias the anvil in an upper position, as shown in FIG. 3, wherein it is movable downwardly against the force of the spring 28 for upsetting a rivet 12.

The rivet 12 is held in position, prior to the upset force being applied by the anvil 16, by a pair of generally semi-cylindrical fingers 32 which together generally surround the lower portion of and extend below the guide 22 and have tips 34 which are chamferred inwardly to grasp the rivet or slug. The fingers 32 ride in a longitudinal anvil slot 42 by means of a dowel pin 36 which holds the finger position. The upper ends of the fingers have radially enlarged portions 39 which are received in a radially inner notch 41 of a clamp ring 40. The fingers 32 are held in a normally closed position, as shown in FIG. 3, by compression spring 38 which is contained within a circumferential outer groove of split clamp ring 40. The clamp ring assembly is biased in the down position, as shown in FIG. 3, by means of compression spring 44, which rides on washer member 43 which is received within a radially outer upper notch of ring 40, so that the fingers 32 are closed about the rivet or slug 12. For inserting a rivet or slug the apparatus 10 is moved into position, as shown in FIG. 1, with the guide 22 and fingers 32 inserted through the central aperture 52 in a pressure foot 50 toward the workpiece holes 13 for insertion of the rivet or slug 12 therein and with flats 46 of clamp ring 40 in engagement with flats 48 of the pressure foot 50. The movement of the clamp ring 40 upwardly relative to the housing 20 as the guide 22 and fingers 32 are moved further through the central aperture 52 of the pressure foot 50 causes movement of the clamp ring 40 including the spring 38 upwardly against the force of the spring 44 so that the fingers 32, with the anvil bottom end riding against the chamfered inner surface of the tips 34, are spread outwardly with the anvil 16 simultaneously pushing the rivet 12 into the workpiece holes. The operation of the fingers 32 is well known in the art and is described in greater detail, for example, in U.S. Pat. No. 4,609,134, which is commonly assigned with the present application and which is incorporated herein by reference.

The housing 20 is attached to the top plate 54 by means of, for example, bolts 56, the top plate 54 having an aperture 55 which receives the upper portion (above enlarged portion 24) of the anvil. The diameter of top plate aperture 55 is less than the diameter of enlarged anvil portion 24 whereby the top plate 54 serves to limit the movement upwardly of the anvil 16. In order to allow the anvil to deflect upwardly to compensate for differences in rivet length, wave springs 58 are provided to surround the anvil between the top plate and a shoulder provided by the enlarged portion 24.

The anvil housing 20 is supported by support ring 60 which is attached to a lower generally cylindrical extension 62 of support member 64 for vertical sliding movement relative thereto. The housing 20 is lockingly attached to the support ring 60 by means of a plurality of circumferentially spaced balls 66 which are held by support 60 partly in a recess 67 in the housing 20 and partly in respective openings 65 in support member 64 but which are movable out of the recess 67 by sliding movement of the support ring 60 upwardly against the force of compression spring, illustrated at 68, and into a lower notch 71 in the inner surface of member 60. The notch 71 defines a shoulder 73 which limits the downward movement of the ring 60 by engaging a surface of housing 20. Support ring 60 is biased by the spring 68 to hold the housing 20 in attachment to the support 64 but wherein the housing and anvil are advantageously removable therefrom for replacement by anvils of other sizes.

Support member 64 is suitably attached, such as by bolts 78, to frame 70 in which is mounted the plunger apparatus 72. The plunger apparatus 72 is mounted for movement with the frame 70, and the entire apparatus 10 is positionable so that the plunger apparatus 72 as well as the tooling 16 may be suitably located by means of a positioning cylinder, illustrated generally schematically at 74 in FIG. 4. Since the provision of a positioning cylinder is within the skill of one of ordinary skill in the art to which this invention pertains, it will not be described in any greater detail herein.

Movement of the plunger 18 downwardly, as illustrated at 80, is effected by a solenoid coil 82 which is supplied with electrical power from a suitable power source, illustrated at 84 in FIG. 2, for applying the force required to upset the rivet or slug 12.

The coil 82 is mounted within the housing 88 to circumscribe the housing vertical opening 86. The plunger 18 is a generally elongate cylindrical member made of steel or other suitable material providing adequate strength for impacting the anvil 16. A suitable bushing 94, which is press fit into the lower portion of housing 88, is provided for guidingly receiving the plunger 18. The bushing 94 rests on a reduced inner diameter lower portion of the housing 88 to thereby insure that the bushing is retained in position.

The upset tool 76 is held to the plunger 18 by a suitable clamp assembly, illustrated generally at 96, which is held in position vertically by a suitable retaining ring 98. The upset tool 76 may also suitably be composed of steel or other suitable material for transmitting the force effected by the solenoid to the anvil 16. The clamp assembly 96 may include a D-shaped bracket (not shown) for mounting the solenoid/plunger assembly 72 and a washer-shaped urethane pad (not shown) for absorbing shock as the plunger is retracted after a stroke, which assembly can be provided using principles commonly known to those of ordinary skill in the art to which this invention pertains.

The upper end of the plunger 18 terminates in a reduced diameter threaded portion 102 which defines a circumferential shoulder 104. The threaded portion 102 is received within an aperture 106 of a generally cylindrical member 108 having an upper portion 110 which engages the threaded portion 102 and a lower portion 112 having an enlarged central opening 114 in communication with the aperture 106 to define a sleeve portion which extends downwardly along the upper portion of the plunger and is radially spaced therefrom with the upper portion 110 resting on the shoulder 104. Member 108 is secured to the plunger 18 by means of washer 116 and nut 118 which is treadedly secured to the plunger portion 102.

The outer diameter of member 108 is less than the diameter of the housing opening 86 so that the member 108 may move downwardly within the housing 88 to the bushing 94. Member 108 is composed of iron or other suitable material which is suitably permeable to magnetic flux provided by the coil 82 for movement downwardly, as illustrated at 80, in response thereto, with a suitable air gap between member 108 and coil 82 being provided in accordance with principles commonly known to those of ordinary skill in the art to which this invention pertains.

At the beginning of a stroke, as illustrated in FIG. 4, the lower end of the member 108 is a short distance within the upper end of the housing 88. The stroke length, illustrated at 122, is the distance between the bottom of the member 108, at the upper position of the plunger, and the bushing 94. This stroke length 122 may be adjusted by means of nut 118. Member 108 also suitably provides an additional amount of mass for achieving the desired rivet upset force, and its movement is transmitted through the plunger 18 and the upset tool 76 to impact the anvil 16 for providing the necessary rivet upset force. This allows a precise upset stroke, illustrated at 126, of the anvil 16 of perhaps up to $\frac{1}{4}$ inch for achieving the precise amount of upset of the rivet 12 which is required. Compression spring 128, which bears between the bushing 94 and the upper portion 110 of member 108 and which surroundingly engages the plunger 18 is provided to bias the plunger upwardly at the end of each stroke so that it is in position for another stroke.

Referring to FIG. 1, there is illustrated a portion of the anvil 16 with the fingers 32 grasping a rivet or slug 12, similarly as illustrated in FIG. 3, for insertion into the holes 13 of members 14 to be riveted. The pressure feet 50 are brought into clamping engagement with opposite sides of the members 14 which comprise the workpiece. The clamp ring 40, shown in FIG. 3, is brought into engagement with and presses against the flat 48 of pressure foot 50 for detaching the fingers from the rivet or slug, and the rivet or slug is simultaneously pressed into the holes 13 with the anvil 16 engaging the end of the rivet or slug 12 for providing the upset force. At 130 is shown a second anvil of another riveting apparatus similar to riveting apparatus 10 but without fingers. Anvil 130 will bear against the other end of the rivet or slug 12 for simultaneous application of the upset force.

Each pressure foot 50 comprises a pair of members 132 and 133 which house between them an impact force transducer 134 with electrical connection thereto provided at 136 and which are bolted together by bolts 138 so that the members 132 and 133 may be squeezed during rivet upset, the amount of squeezing sensed by transducer 134 to determine whether equal forces are being applied during upset on both sides of the members 14 so that panel movement may be monitored and minimized by coordinating the application of force so that it is applied simultaneously to each side of the workpiece. This may be done using principles commonly known to those of ordinary skill in the art to which this invention pertains. The transducer 134 may, for example, be a quartz force ring No. 207A provided by PCB Piezotronics of Buffalo, N.Y.

FIG. 2 illustrates the controlled supply of electrical power for operating the solenoid apparatus 72. The prior art approach of dumping charge from a capacitor bank does not allow upset time versatility so as to, for example, minimize rivet cracking. Since the capacitor bank must be recharged after each application of force, it also does not suitably allow vibratory insertion of fasteners. In order to provide upset time versatility while maintaining the preciseness of uniformity of rivet upset which is increasingly being demanded by the government and the public in aerospace applications and the like, in accordance with the present invention a current controller is electrically connected to the solenoid coil 82 for providing current in such magnitude and time duration to develop sufficient force from the solenoid to effect riveting. Such current control may be provided, for example, by a DC pulse width modulated servo-amplifier 140 providing amperage feedback control for stabilization of the internal network so that uniform current may be provided to the solenoid coil 82 to achieve upset time versatility while maintaining uniformity of rivet upset. By way of example, an illustrative servo-amplifier 140 is commercially available from Industrial Drives Corp. under the designation SBD 4. Information as to the desired condition is provided by a suitable microprocessor 160, which provides a setpoint signal to the servo-controller 140 via line 164 and which is controlled by a suitable machine logic controller 162. A condition such as, for example, plunger velocity or force being applied to a rivet or slug, is sensed as the plunger is being driven for upsetting a rivet, and signals indicative of the condition are fed back to the servo-controller 140. The servo-controller 140 is responsive to the signals which are fed back thereto for controlling the sensed condition during movement of the plunger 18 for forming a rivet.

FIG. 2 illustrates two different condition sensing means in the forms of a linear velocity transducer, illustrated at 142, and a force transducer, illustrated at 152. It should be understood that, in accordance with the present invention, either or both or another suitable condition sensing means may be provided in a riveting apparatus.

The linear velocity transducer 142 is operatively connected to the plunger 18 for sensing the velocity thereof and feeding back to the servo-controller 140 through line 144 signals which are suitably amplified and filtered by conditioning amplifier 146, and the resulting signals are compared with the setpoint signal provided through line 164. The current from the servo-controller along line 148 is accordingly varied based on the comparison with the setpoint signal so that the velocity of the plunger 18 may be instantaneously adjusted as it is being driven for upsetting a rivet. By way of example, a suitable velocity transducer is commercially available from Transtek Inc. of Ellington, Conn. and identified as Series 100. The use of the signals from the linear velocity transducer 142 to adjust the current is within the knowledge of those of ordinary skill in the art to which this invention pertains. The linear velocity transducer 142 comprises a solenoid core 145 which is suitably attached to the plunger 18 for movement therewith and a stationary coil 147 within a housing 149 which housing is maintained in a stationary position above the plunger 18 by means of a bracket 150. The transducer 142 may, in accordance with the present invention, be otherwise suitably connected for signalling plunger velocity. Thus, the solenoid 142 produces a current from which plunger velocity can be determined during the stroke of the plunger. By feeding back this information to the servo-controller 140, the current supplied to the solenoid coil 82 may be instantaneously adjusted to vary the velocity of the plunger to the desired velocity. The amplified and conditioned velocity transducer signal from amplifier 146 may also be transmitted via line 166 to microprocessor 160 for monitoring thereof and/or for coordinating with the signals from the force transducer 152 or other condition sensing means as hereinafter described.

Force transducer 152 is illustrated as being applied on the top surface of the anvil 16 so that it is squeezed between the anvil 16 and the upset tool 76 during a stroke, but may be instead built into the anvil or otherwise suitably disposed in accordance with principles commonly known to those of ordinary skill in the art to which the present invention pertains. Signals representative of force applied between the plunger upset tool and anvil are suitably amplified and filtered by conditioning amplifier 156 and are then fed back to the microprocessor 160 through line 154 for monitoring thereof and/or for coordinating with the signals from the velocity transducer as hereinafter described. The force transducer 152 may, for example, be a piezoelectric device which generates a current which is proportional to the "squeeze" applied thereto between the plunger upset tool and anvil. By way of example, a suitable force transducer may be provided by A. L. Design, Inc. of Buffalo, N.Y. The use of force transducer 152 may be a preferred type of feedback mechanism for very short plunger strokes.

When both a linear velocity transducer 142 and a force transducer 152 are used to provide feedback to the servo-amplifier 140 for controlling current, the linear velocity transducer 142 would be used to control the plunger velocity until the point of anvil impact after which the force transducer would be used. It may, for example, also be desirable to use both transducers 142 and 152 in situations where the rivet has a tendency to spring back. Thus, the linear velocity transducer 142 may be used in controlling the velocity for applying the desired upset force, and the applied force may be "held" for a period of time by use of the force transducer 152.

The use of both the linear velocity transducer 142 and the force transducer 152, or other condition sensing means, during a riveting operation requires coordination between the feedback signals. Thus, during the plunger stroke prior to anvil impact the velocity feedback signal through line 144 is compared with the setpoint signal through line 164 to deliver a servo-amplifier output 148 for precisely controlling the plunger velocity. However, upon impact with the anvil, the plunger velocity drops rapidly to zero at which time it would be desired that the force transducer feedback be activated. Upon receipt of a signal through line 166 indicating zero or near zero plunger velocity indicative of anvil impact, the microprocessor 160 signals the servo-amplifier 140 through mode select line 168 to switch from comparison between the velocity feedback signal 144 and setpoint signal 164 to a comparison between a force feedback signal through line 170 from the microprocessor 160 and the setpoint signal 164. Thus, force feedback is provided through line 154 to the microprocessor and then through line 170 to the servo-amplifier. If only the force transducer 152 were used for condition feedback, the signal therefrom may alternatively be transmitted directly to the servo-amplifier for comparison with the setpoint for controlling the force being applied during rivet upset.

Since the lengths of fasteners vary such as by having single-headed, double-headed, or unheaded ends so that different stroke lengths may be required for anvils 16 and 130 at opposite ends of a fastener, it is also desirable to precisely control the plunger starting positions. This may be achieved by means of a linear displacement transducer 172 which may be operatively connected to plunger 18 similarly as the linear velocity transducer 142 is connected and which is illustrated in FIG. 2 but not in FIG. 4, it being mountable using principles commonly known to those of ordinary skill in the art to which this invention pertains. Signals from phase sensitive demodulator 178 of position transducer 172 to microprocessor 160 through line 174 indicating plunger position are used as part of a positioning loop that is controlled by the microprocessor 160 to position the plunger 18 at a predetermined distance from the anvil 16 prior to initiation of plunger motion for rivet upset. Transducer 172 further includes a linear variable differential transformer coil assembly having windings 184 and 186 within which is movable linearly with the plunger 18 a core 182 and also includes a modulator 180 for providing excitation supply. The oscillator 180 converts a DC input to AC, exciting the primary winding 184 of the differential transformer. Voltage is induced in the axially spaced pair of secondary windings 186 by the axial core position. The two secondary circuits 186 each consists of a winding, a full-wave bridge, and an RC filter. The circuits 186 are connected in series opposition so that the resultant output voltage is proportional to core displacement from the electrical center. The polarity of the voltage is a function of the direction of the core displacement from the electrical center. The core 182, when displaced axially within the coil assembly, produces a voltage change in the output which is directly proportional to the displacement. Signals indicative of this voltage change are transmitted through line 174 to the microprocessor 160 for use in precisely positioning the plunger 18 prior to initiation of plunger movement for rivet upset. By way of example, a suitable linear displacement transducer is commercially available from Transtek Inc. of Ellington, Conn. and identified as Series 240 (with the oscillator and demodulator built in) or 210 or 220 (with a separate oscillator and demodulator).

A linear displacement transducer is considered to be desirably rugged and reliable. However, if desired, a high resolution linear pulse encoder may be provided for control of the plunger starting position.

A similar microprocessor 196 and servo-amplifier (not shown) along with condition sensing means and linear displacement transducer may be provided for control of the plunger (not shown) for anvil 130 for impacting the other rivet end. By controlling the plunger initial positions and velocities for each of the anvils 16 and 130, a desired simultaneous rivet impact may be achieved. Overall coordination of the microprocessors 160 and 196 is provided by logic controller 162 through lines 188 and 190 respectively. The logic controller 162 and microprocessors 160 and 196 can be suitably programmed in accordance with principles commonly known to those of ordinary skill in the art to which this invention pertains.

If desired, the plunger 18 may be returned to the initial or upper position by merely changing the direction of current through the coil 82 in which case the compression spring 128 may be eliminated. This advantageously allows the solenoid assembly to be lighter and more compact and allows all of the force generated to provide downward plunger movement instead of a portion of the force being required to overcome the force of the spring 128.

If the plunger were touching the anvil at the time upset force is initiated, its velocity would be zero and require application quickly of sufficient force to achieve upset with the result that a short upset time is required with the undesirably accompanying greater possibility of rivet cracking. Because the plunger 18 of the present invention is moving at a velocity of perhaps 60 ft. per sec. at the time upset force is initiated, the linear velocity transducer 142 allows the plunger velocity to be controlled so that, for example, the plunger 18 may be decelerating at the time of impact with the anvil 16 so that the fastener upset time may be varied within a range of perhaps 0.001 to 0.005 seconds to afford an opportunity to minimize fastener cracking or for any other purpose it would be desired to vary the upset time.

Since the prior art approach of dumping charge from a capacitor bank for developing plunger force is a "one-shot" process which undesirably requires a period of time for the capacitor bank to be recharged before it can again provide plunger force, the use of an electromagnetic apparatus with such a capacitor bank may not be suitable for vibratory insertion of interference-fit fasteners such as lock bolts. The versatility of plunger control of the present invention allows power to be supplied to the solenoid coil in a rapid succession of pulses to effectively achieve such vibratory insertion.

The power required by the prior art LVER for upsetting a rivet must be applied as a "one-shot" from a capacitor bank in a short period of time with the plunger initially touching the rivet. This undesirably requires a high operating current in the range of perhaps about 20,000 amps. In accordance with the present invention, by using the plunger momentum to achieve the upset force, work is performed over a relatively long period of time before rivet impact with a result that the apparatus of the present invention may desirably operate at a safer and more economical lower current of perhaps about 200 amps with a correspondingly low voltage.

Thus, in accordance with the present invention the condition of the solenoid plunger may be instantaneously controlled during its movement for rivet upset whereby upset time versatility can be achieved so that fastener cracking may be minimized while maintaining the desired upset uniformity. An anvil, with its short stroke, allows locating and positioning of a rivet or slug automatically after which the plunger, with its long stroke, provides the upset force required. Thus, there is provided electromagnetic riveting apparatus for low amperage automated operation for achieving a higher quality uniform rivet upset safely.

It should be understood that while the invention has been described in detail herein, the invention can be embodied otherwise without departing from the principles thereof. For example, it is envisioned that two solenoid coils may be provided. One coil would be used for effecting the desired plunger velocity prior to its impact with the anvil. The other coil would be used to control plunger force and movement during rivet upset. Such other embodiments are meant to come within the scope of the present invention as defined by the appended claims.

What is claimed is:

1. Electromagnetic riveting apparatus comprising: electromotive means in the form of a solenoid having a plunger including means for effecting a stroke of said plunger; tooling means for converting force developed during the stroke of the solenoid plunger into rivet upsetting force; means for spacing said plunger at a predetermined distance from said tooling means for initiation of the stroke whereby to drive the plunger into impact with the tooling means during the stroke; and current control means operatively connected to the solenoid for providing current in such magnitude and time duration to develop sufficient force from the solenoid during the stroke to effect riveting a metal workpiece in a manner providing a fluid-tight joint between the rivet and workpiece.

2. Riveting apparatus comprising solenoid means, means for impacting a fastener, servo-controller means operatively connected to said solenoid means for controlling supply of current to said solenoid means for driving said impacting means to impact a fastener, and means for sensing a condition of said impacting means as it is driven for impacting a fastener and for feeding back to said controller means signals indicative of said condition, said controller means being responsive to the signals from said sensing means for controlling said condition during movement of said impacting means for impacting a fastener.

3. Apparatus according to claim 2 wherein said impacting means comprises an anvil means and also comprises a plunger spaceable from said anvil means and responsive to said controller means for impacting said anvil means to effect impacting of the fastener by said anvil means.

4. Apparatus according to claim 2 further comprising another impacting means, said impacting means positioned relative to each other to impact opposite ends of the fastener, the apparatus further comprising means for simultaneously impacting the fastener at both ends whereby workpiece movement may be minimized.

5. Riveting apparatus comprising solenoid means, means for impacting a fastener, servo-controller means operatively connected to said solenoid means for controlling supply of current to said solenoid means for driving said impacting means to impact a fastener, and velocity transducer means for sensing the velocity of said impacting means and for feeding back to said controller means signals indicative of the impacting means velocity, said controller means being responsive to the signals from said velocity transducer means for controlling the velocity of said impacting means during the movement of said impacting means for impacting the fastener.

6. Apparatus according to claim 5 further comprising force transducer means for sensing the force applied to the fastener as it is impacted by said impacting means and for feeding back to said controller means signals indicative of the force being applied to the fastener, said controller means being responsive to the signals from said force transducer means for controlling the force applied to the fastener by said impacting means as the fastener is being impacted by said impacting means.

7. Apparatus according to claim 5 wherein said impacting means comprises an anvil means and also comprises a plunger responsive to said controller means for impacting said anvil means to effect impacting of the fastener by said anvil means.

8. Riveting apparatus comprising solenoid means, means for impacting a fastener, servo-controller means operatively connected to said solenoid means for controlling supply of current to said solenoid means for driving said impacting means to form a fastener, and force transducer means for sensing the force applied to the fastener as it is impacted by said impacting means and for feeding back to said controller means signals indicative of the force being applied to the fastener, said controller means being responsive to the signals from said force transducer means for controlling the force applied to the fastener by said impacting means as the fastener is being impacted by said impacting means.

9. A method of riveting comprising providing rivet upset tooling in contact with a rivet, spacing a plunger of a solenoid at a selected distance from the tooling, supplying current to the solenoid to effect movement of the plunger to impact the tooling thereby converting the plunger movement to rivet upset forced and controlling the solenoid current so that current is provided in such magnitude and time duration to develop sufficient force from the solenoid to effect riveting of a metal workpiece in a manner providing a fluid-tight joint between the rivet and workpiece.

10. A method according to claim 9 further comprising applying simultaneous rivet upset force to both ends of a rivet whereby workpiece movement may be minimized.

11. A method according to claim 9 wherein the step of converting the plunger movement to rivet upset force comprises providing an anvil in contact with the rivet, spacing the plunger from the anvil, and effecting movement of the plunger toward the anvil to impact the anvil by the supply of current to the solenoid.

12. A method of riveting comprising supplying current to a solenoid to effect movement of a plunger, converting the plunger movement to rivet upset force, and controlling the solenoid current so that current is provided in such magnitude and time duration to develop sufficient force from the solenoid to effect riveting of a metal workpiece in a manner providing a fluid-tight joint between the rivet and workpiece, the method further comprising varying the solenoid current to provide a rapid succession of pulses for vibratory insertion.

13. A method of riveting comprising supplying current from a servo-controller to a solenoid to effect impacting of a fastener, sensing a condition relative to the impacting of the fastener, feeding signals indicative of the sensed condition to the servo-controller to control the current supplied to the solenoid to control the sensed condition during the effecting of the impacting of a fastener.

14. A method according to claim 13 wherein the step of sensing a condition comprises sensing the velocity of a plunger for effecting impacting of a fastener.

15. A method according to claim 13 wherein the step of sensing a condition comprises sensing the force applied to the fastener as it is impacted.

16. A method according to claim 13 wherein the step of effecting impacting of a fastener comprises effecting movement of a plunger by the solenoid, positioning an anvil for impacting the fastener, and effecting striking of the anvil by the plunger.

17. A method according to claim 13 wherein the step of effecting impacting of a fastener comprises providing an anvil in contact with the fastener, providing a plunger responsive to the servo-controller for providing force for impacting the fastener, spacing the plunger from the anvil, and controlling the current supplied to the solenoid to effect movement of the plunger toward the anvil to impact the anvil.

18. A method according to claim 17 further comprising reversing the polarity of current to the solenoid after the fastener is impacted to return the plunger to its initial position spaced from the anvil.

19. A method of riveting comprising supplying current from a servo-controller to a solenoid to effect impacting of a fastener, sensing a condition relative to the impacting of the fastener, feeding signals indicative of the sensed condition to the servo-controller to control the current supplied to the solenoid to control the sensed condition during the effecting of the impacting of a fastener, the method further comprising varying the current to the solenoid to provide a rapid succession of pulses for vibratory insertion of the fastener.

20. A method of riveting comprising supplying current from a servo-controller to a solenoid to effect impacting of a fastener, sensing a condition relative to the impacting of the fastener, feeding signals indicative of the sensed condition to the servo-controller to control the current supplied to the solenoid to control the sensed condition during the effecting of the impacting of a fastener, wherein the step of effecting impacting of a fastener comprises providing an anvil in contact with the fastener, providing a plunger responsive to the servo-controller for providing force for impacting the fastener, spacing the plunger from the anvil, and controlling the current supplied to the solenoid to effect movement of the plunger toward the anvil to impact the anvil, the method further comprising varying the current to the solenoid to provide a rapid succession of pulses for vibratory insertion of the fastener.

* * * * *